US007938226B2

(12) United States Patent
Bagheri

(10) Patent No.: US 7,938,226 B2
(45) Date of Patent: May 10, 2011

(54) EXHAUST SYSTEM FOR INTERNAL COMBUSTION ENGINE HAVING TEMPERATURE VARIABLE ACOUSTICS

(76) Inventor: Ramin Bagheri, La Jolla, CA (US)

( * ) Notice: Subject to any disclaimer, the term of this patent is extended or adjusted under 35 U.S.C. 154(b) by 0 days.

(21) Appl. No.: 12/391,182

(22) Filed: Feb. 23, 2009

(65) Prior Publication Data

US 2009/0211841 A1 Aug. 27, 2009

Related U.S. Application Data

(60) Provisional application No. 61/066,606, filed on Feb. 21, 2008.

(51) Int. Cl.

| | |
|---|---|
| ***F01N 13/18*** | (2010.01) |
| ***F01N 13/16*** | (2010.01) |
| ***F01N 1/16*** | (2010.01) |
| ***F01N 1/00*** | (2010.01) |

(52) U.S. Cl. ..... 181/241; 181/237; 181/244; 181/254

(58) Field of Classification Search ..... 181/241, 181/237, 254

See application file for complete search history.

(56) References Cited

U.S. PATENT DOCUMENTS

| | | | | |
|---|---|---|---|---|
| 1,709,426 | A * | 4/1929 | Beery | 181/254 |
| 1,860,146 | A * | 5/1932 | Gray | 181/254 |
| 4,527,659 | A * | 7/1985 | Harrington | 181/244 |
| 6,739,579 | B1 * | 5/2004 | Rim | 251/306 |
| 7,325,651 | B2 * | 2/2008 | Kikuchi et al. | 181/237 |
| 2005/0061580 | A1 * | 3/2005 | Wiemeler et al. | 181/254 |
| 2005/0132696 | A1 * | 6/2005 | Tumati et al. | 60/282 |
| 2007/0227807 | A1 * | 10/2007 | Meneely et al. | 181/237 |

* cited by examiner

*Primary Examiner* — Elvin G Enad
*Assistant Examiner* — Christina Russell
(74) *Attorney, Agent, or Firm* — Donn K. Harms

(57) ABSTRACT

A muffler for an internal combustion engine featuring two flowpaths for exhaust through the muffler. A first serpentine pathway is substantially longer than a second pathway through the muffler, thereby providing increased sound attenuation. Temperature activated internal valves operate to change the exhaust flowpath from the first flowpath to the second flowpath through the muffler as exhaust gasses warm the muffler and the temperature actuated valves.

4 Claims, 4 Drawing Sheets

EXHAUST SYSTEM FOR INTERNAL COMBUSTION ENGINE HAVING TEMPERATURE VARIABLE ACOUSTICS

FIELD OF THE INVENTION

This application claims priority to U.S. Provisional Patent Application No. 61/066,606 filed Feb. 21, 2008 and which is incorporated herein in its entirety by reference. The present invention relates to noise baffling for the exhaust system of an internal combustion engine. More particularly it relates to a muffler adapted for engagement to the exhaust of an internal combustion engine which varies the acoustic output of the exhaust system to which it is engaged depending on the temperature of the incoming exhaust gas from the engine.

BACKGROUND OF THE INVENTION

Combustion engines typically emit a much louder exhaust sound when the engine is initially started while the engine is cold. Once the engine is warmed up, the exhaust sound emitted is substantially decreased. A number of factors effect the noise difference including the fact that cold engines are fed a richer fuel mixture during the warm up period.

The exhaust noise reduction properties of the muffler or other engine exhaust silencer are effected by the length and shape of the resonance chambers of the muffler as well as the flow path into and exhausting from the muffler. Conventional mufflers are designed to be static in their muffling capability and produce a fixed amount of noise suppression, due in particular to the fixed length of their resonance chambers and the resulting flowpath through the muffler housing.

As a result, such a muffler when installed on an internal combustion engine may be excessively loud during the "cold start" and warmup condition (when the engine and exhaust system are cold) since the muffler is tuned with the proper or desired loudness and general sound emission characteristics during warm engine operation of the engine and exhaust system. As such, conventional mufflers can cause loud and sometimes obnoxious exhaust sounds during the first several minutes of engine operation after starting the engine.

As a consequence, there is an unmet need for an exhaust system with temperature dependent variable acoustic properties. Such a muffler should be configured to increase noise suppression during the "cold start" conditions of an engine to eliminate the excessive noise. Such a device should thereafter decrease noise suppression once the engine and muffler are warmed to avoid inhibiting engine performance and to provide a desirable sporty exhaust sound to be emitted at a proper sound volume and quality at all times during the long term warm operation period of the engine.

With respect to the above, before explaining at least one preferred embodiment of the engine muffler invention in detail or in general, it is to be understood that the invention is not limited in its application to the details of construction and to the arrangement of the components or the steps set forth in the following description or illustrated in the drawings. The various apparatus and methods of the disclosed muffler invention are capable of other embodiments, and of being practiced and carried out in various ways, all of which will be obvious to those skilled in the art once the information herein is reviewed. Also, it is to be understood that the phraseology and terminology employed herein are for the purpose of description and should not be regarded as limiting.

As a consequence, those skilled in the art will appreciate that the conception upon which this disclosure is based may readily be utilized as a basis for designing temperature variable mufflers for internal combustion engines and the like, and for carrying out the several purposes of the present disclosed device and method. It is important, therefore, that the embodiments, objects and claims herein, be regarded as including such equivalent construction and methodology insofar as they do not depart from the spirit and scope of the present invention.

SUMMARY OF THE INVENTION

The internal combustion muffler device having temperature dependent variable acoustic properties, as disclosed herein, provides for a muffler or silencer which adjusts the flowpaths of exhaust through the muffler to provide increased noise suppression during cold running periods and decreased suppression once the engine has warmed to operating temperature. The disclosed device employs a muffler housing having a temperature activated internal valve or valves which adjust the flowpath of exhaust gasses through the muffler depending on the temperature of the incoming exhaust gasses. The temperature dependant valving may also be effected by a conduction of heat from the engine block to the muffler or silencer via connecting exhaust conduits.

The communication of heat to the muffler device and heat operated valving provides a means to adjust the valving and resulting gas flowpath through the muffler housing to achieve a greater attenuation of sound upon the initial starting of a cold engine. As the engine warms during normal operation, the muffler or silencer concurrently warms, causing a resulting adjustment of the internal temperature activated valving within the muffler housing and adjusts the flowpath of the exhaust gasses through the muffler. This adjustment causes a reducing of the sound attenuation properties of the muffler which are not needed for a fully warmed engine.

As such, the disclosed temperature dependant muffler device herein provides variable acoustic properties providing increased sound attenuation during the "cold start" conditions of an internal combustion engine, and progressively decreasing sound attenuation as the engine warms. Once fully warmed, the valving of the disclosed device will induce the engine exhaust gasses along a flowpath adapted for less sound attenuation and less back pressure for the exhaust gasses during the operating or warm running condition of the engine. The second flowpath dictated by the internal valving of the device will therefor allow a more desirable exhaust sound to be emitted from the muffler during the warm running condition of the engine.

THE OBJECTS OF THE INVENTION

It is therefore an object of the present invention to provide an internal combustion engine muffler which provides increased sound suppression or attenuation during the cold starting period of the engine to which it is engaged.

It is another object of this invention to provide such a muffler that employs temperature dependant internal valving which will progressively decrease sound attenuation of the device as the engine warms thereby allowing for decreased back pressure during engine operation periods.

The foregoing has outlined some of the more pertinent objects of the invention. These objects should be construed to be merely illustrative of some of the more prominent features and applications of the intended invention. Many other beneficial results can be attained by applying the disclosed method and device in a different manner or by modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

BRIEF DESCRIPTION OF THE DRAWINGS

The accompanying drawings, which are incorporated herein and form a part of this specification, illustrate preferred embodiments of the invention and together with the detailed description, serve to explain the principles of this invention.

DETAILED DESCRIPTION OF THE PREFERRED EMBODIMENTS

Figure 1:
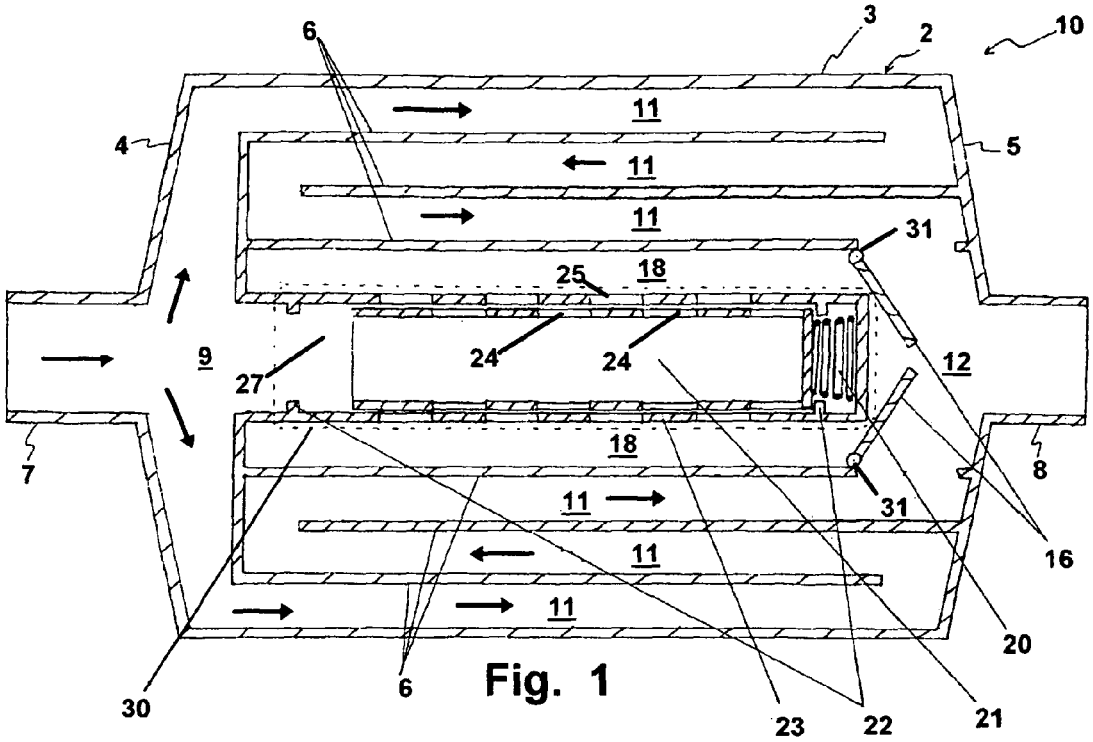
FIG. 1 depicts a cross-sectional view of a preferred mode of the device herein disclosed showing a temperature dependent valve in a first position for cold start and running of the engine.

Referring now to the drawings, wherein similar parts of the invention are identified by like reference numerals, the device provides a muffler for an internal combustion engine which employs one or a plurality of temperature dependant valves as a means to change the flowpath of the exhaust through the muffler. The flowpaths vary as the temperature dependant means for valving the internal conduits of the muffler change position as a result of being heated by the engine and exhaust gasses communicated to the muffler during engine operation. The changing flow paths for exhaust gasses provided by the temperature dependant valving thus varies the noise suppression properties of the muffler by changing the overall length and shape of the resonance chamber in response to temperature.

Figure 3:
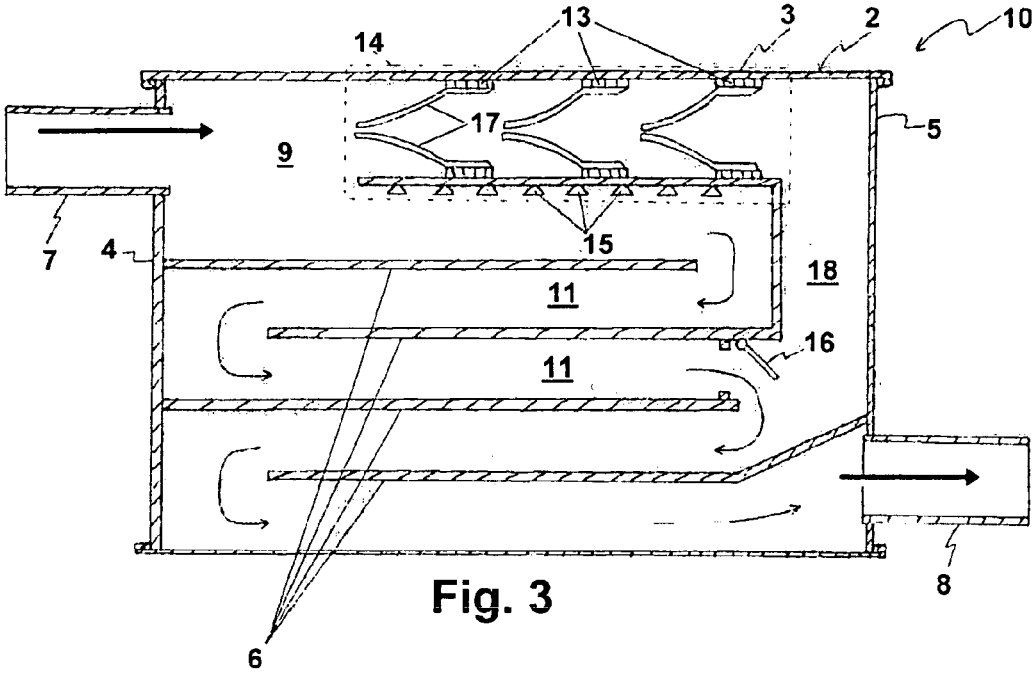
FIG. 3 depicts a cross-sectional view of an alternative embodiment of the disclosed device showing another means for heat activated valving of gas flowpaths which employs a temperature dependant flap valve in a first position during cold running of the engine.

As shown in FIGS. 1, and 3, the muffler device 10 employs differing means for temperature induced valving of the internal conduits providing a plurality of flowpaths for engine exhaust through the muffler device 10. As depicted in FIGS. 1 and 3, the muffler device 10 provides a first flowpath for exhaust communicated from the engine when it is first started from a "cold start" and the muffler device 10 is also cold.

As shown in FIGS. 1-4, the housing is formed by the main body 2 consisting of a substantially tubular shell 3 and end walls 4,5 for closing one end and the other end of the shell 3. The internal cavity of the housing is divided into several baffle or silencer chambers 9, 11,12, and 18 by dividing walls 6. An exhaust gas inlet pipe 7 and an exhaust gas outlet pipe 8 form passages for exhaust gas into and out of the housing of the muffler device 10.

The dividing walls 6 are arranged within the housing of the device 10, in a substantially adjacent and parallel manner to form a serpentine pathway for exhaust flow. An exhaust inlet chamber 9 directly communicates with the exhaust gas inlet pipe 7, which is in sealed communication with the exhaust manifold of the engine. A means for temperature valving of the internal passages of the device 10 is provided by spring loaded valves 16 and a sliding tube 21 biased by a temperature activated spring 20 or other means for temperature activated biasing of the tube 21 within the central housing 27.

In the cold state, exhaust entering the muffler housing or main body 2 from the engine when cold, is flow directed by a means temperature actuated valving which is also cold and therefor in a closed position which directs the exhaust gasses through a first flowpath formed by an elongated serpentine length of conduit defining a resonance chamber 11, before reaching the baffle chamber 12 and exiting the muffler device 10.

The elongated nature of this first pathway of the resonance chamber 11, which the open valve 16 allows gasses to follow, thus increases the sound suppression characteristics of the muffler device 10 when cold. As noted this reduces the excessively loud and obnoxious sound communicated from conventional mufflers during a "cold start" condition.

The muffler device 10 warms, primarily due to hot exhaust gasses passing from the exhaust inlet 7 through its passageways to the outlet 8, and by a second means for warming provided by heat directly conducted to the muffler device 10 through its physical engagement at the inlet 7 with metal exhaust pipes leading from the exhaust manifold of the engine to the muffler device 10.

Figure 2:
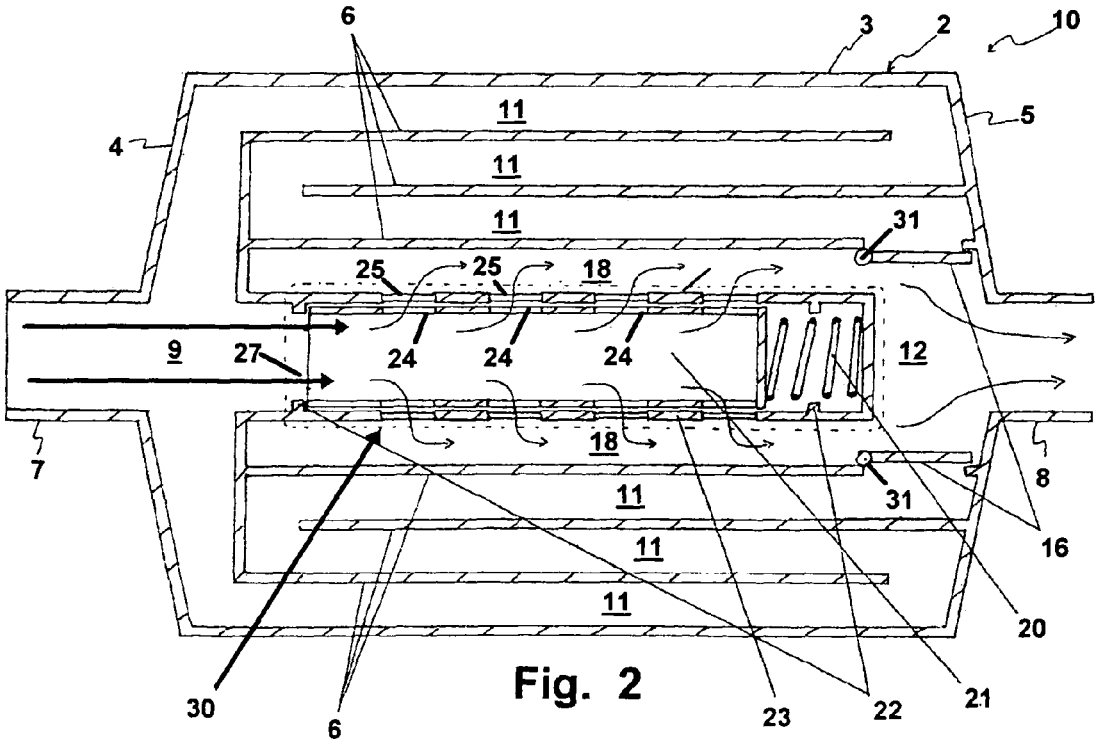
FIG. 2 depicts a cross-sectional view of the disclosed device depicted in FIG. 1 showing a temperature dependent valve having moved to a second position subsequent to the engine reaching a warmed state.

As the muffler device 10 warms due to communicated heat thereto, the first temperature activated valve 16 located at a juncture of the first pathway formed by the resonance chamber 11 and the outlet 8, moves from the open position in FIG. 1 to the closed position of FIG. 2.

Concurrently, the heat communicated to the muffler device 10 causes opening of a temperature dependant valve 30 component through the heating of a heat-activated means for biasing to increase its biasing force. As depicted this heat increased biasing is provided by expansion of a spring 20 to induce a biasing of a translating tube 21 within chamber walls 23, between tube stops 22, from a first position where apertures 24 in the tube 21 are blocked, to a second position where apertures 24 in the tube 21 align with apertures 25 communicating through the walls within in a central housing 27 to chamber 18 communicating directly with outlet pipe 8.

This alignment of apertures 24 and 25 and closure of valves 16, forms a second pathway for exhaust gasses from the inlet chamber 9 to the outlet pipe 8 which is much shorter and thus provides reduced back pressure and reduced noise attenuation. This opening of the valves 16 and concurrent alignment of apertures 24 and 25 from the translation of the tube 21, allow the exhaust gasses to follow the second pathway and bypass the extra length the passage formed by the serpentine resonance chamber 11. The temperature activated valve 16 as depicted in FIGS. 1-2 features a spring loaded valve mechanism which consists of a hinged door valve a plate-like valve as shown, which is biased to the closed position of FIG. 2 by heat increasing spring biasing by the spring (not shown) engaged to the hinge pin 31.

Exhaust, in the heated condition of the muffler device 10, thus follows a shortened path through the muffler device 10 thus decreasing the sound suppression characteristics of the muffler device 10. This allows the desired, sporty exhaust note of the muffler device 10 when the engine and muffler are warm.

With the temperature dependent valve 30 closed, the exhaust gasses will generally cease communication through the long silencer chamber 11. When the temperature dependent valve device 30 is open by alignment of the apertures 24 and 25, the spring loaded valve mechanism 16 prevents exhaust gases that are flowing from the short silencer chamber 18 to the common silencer chamber 12 from entering the long silencer chamber 11 in a retrograde fashion.

However, if the pressure of the exhaust gasses in the long silencer chamber 11 exceed the force of the biasing means closing the valve mechanism 16, that excess pressure will force open the spring loaded valve mechanism 16 and allow exhaust gas communication through both the first and second pathway to the common silencer chamber 12 and an exit through the exhaust gas outlet pipe 8.

In both FIG. 1 and FIG. 2, the actual lengths of the long silencer chamber 11, short silencer chamber 18, and common silencer chamber 12 are not drawn to scale and are exemplar only. The actual lengths of these chambers, and therefore the sound attenuating properties of the device 10, can be varied to suit the overall sound attenuating needs of the muffler device on the engine to which it is engaged.

FIG. 3 depicts an alternative mode of the present invention with a temperature dependent valve device 10 employing slightly different first and second temperature dependant valving means to change exhaust flow between first and second flowpaths. As shown in FIG. 3, the internal space of the main body 2 is divided into several chambers 9, 11, 12 and 18 by dividing walls. The exhaust gas inlet pipe 7 and an exhaust gas outlet pipe 8 form the passages for exhaust gas into and out of the main body 2.

The dividing walls are arranged in the main body 2 of the interior chamber of the device 10 in a manner substantially parallel to the center axis of the tubular shell 3. An exhaust inlet chamber 9 directly communicates with the exhaust gas inlet pipe 7. The first pathway is formed by the long silencer chamber 11 communicating through the open spring loaded valve 16 shown in FIG. 3. The short silencer chamber 18 provides the second and shorter pathway to the outlet pipe 8 from the inlet chamber 9.

The temperature dependent flap valves 14 are attached to the valve seat or base 13 which is composed of a material suited to conduct heat from the tubular shell 3 and heat sinks 15 to the flap 17 of the temperature dependent flap valves 14

In this mode, the device 10 exhaust gasses flowing into the exhaust gas inlet pipe, flows into the exhaust inlet chamber 9. From the exhaust inlet chamber 9, the exhaust gas may flow either along the first flowpath through the long silencer chamber 11 when the device 10 is cold, or to the short silencer chamber 18 when the device is heated to a point where the temperature of the temperature dependent flap valves device 14 open as in FIG. 4.

As in the first mode of FIGS. 1-2, the spring loaded valve 16 may be created with either a hinged door valve, a plate-like valve, or other pressure activated valve device as a valve for opening and closing the valve opening. The spring loaded valve 16 is sufficiently tensioned to keep the spring loaded valve mechanism 16 in a closed position when the temperature dependent flap valves 14 are in the open position. The appropriately tensioned spring loaded valve 16 can be forced open by the pressure of the exhaust gas in the long silencer chamber 11 when the temperature dependent flap valves 14 are closed. When the temperature dependent flap valves 14 are open, the spring loaded valve 16 serves to prevent exhaust gasses that are flowing from the short silencer chamber 18 to the common silencer chamber 12 from entering the long silencer chamber 11 in a retrograde fashion.

Figure 4:
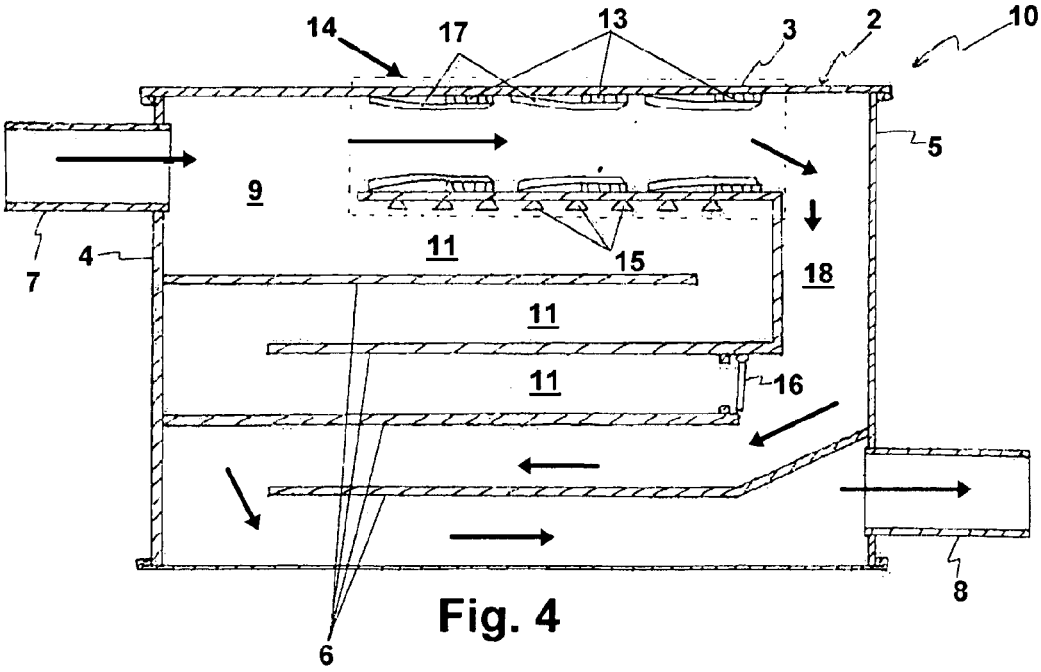
FIG. 4 depicts a cross-sectional view of an the device of FIG. 3 with the means for temperature dependant valving in the form of a flap valve moved to the warm running state.

As noted, FIG. 4 depicts the mode of the device 10 of FIG. 3, with the muffler device 10 moved to the heated state. With the muffler device 10 in the heated state, the temperature dependent flap valves 14 are in the open position and the spring loaded valve 16 is in the closed position with the exhaust gases taking the second pathway through the device 10.

Figure 5:
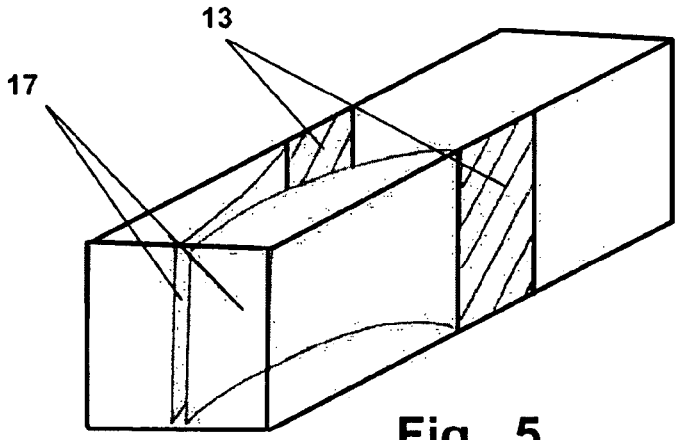
FIG. 5 depicts a perspective view of the means for temperature dependent valving in the form of the flap valve as positioned in the first or cold running position.

FIG. 5 depicts an enlarged perspective view of a single temperature dependent flap valve device 14 depicted in FIGS. 3 and 4. In FIG. 5, the temperature dependent valve 14 is in the cold state and the valve is closed, blocking the flow of exhaust gasses.

Figure 6:
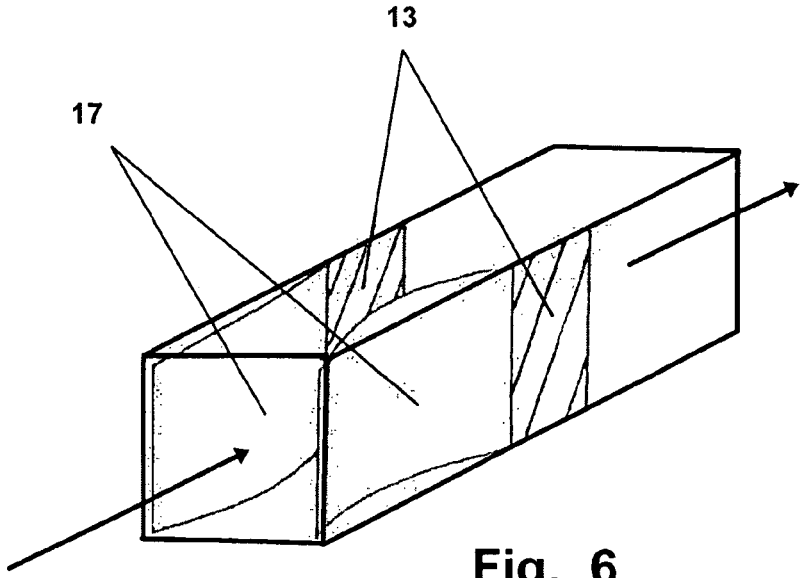
FIG. 6 depicts a perspective view of the temperature dependent flap valve in FIG. 5, wherein the valve had moved to an open state having been warmed by the exhaust and engine.
Figure 7A:
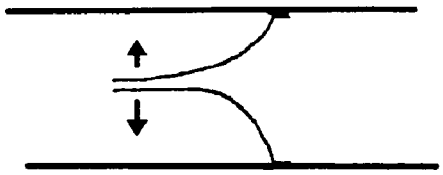
FIG. 7*a* shows a flap valve having dual flap portions.
Figure 7B:
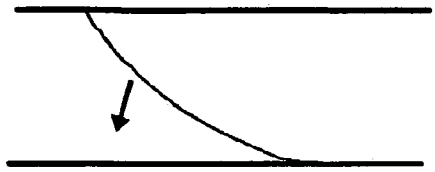
FIG. 7*b* depicts a single flap valve means for temperature dependant valving.
Figure 7C:
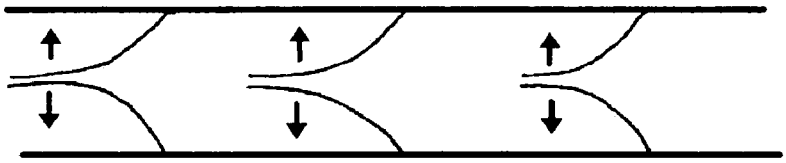
FIG. 7*c* depicts multiple inline dual flap valves.
Figure 7D:
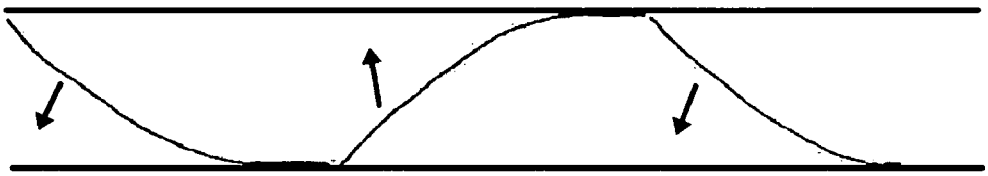
FIG. 7*d* shows multiple inline single flap valves.
Figure 7E:
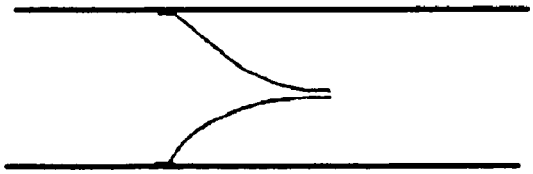
FIG. 7*e* depicts a reverse configuration of the flap valves of FIG. 7*a*.
Figure 7F:
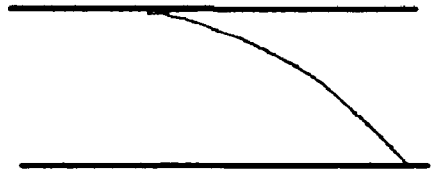
FIG. 7*f* shows a reverse configuration of the flap valve of FIG. 7*b*.

FIG. 6 depicts an enlarged perspective view the single temperature dependent flap valve 14 in the heated state with the valve 14 open, allowing free flow of exhaust gasses through the valve 14.

FIGS. 7*a*-7*f* show different modes of the temperature dependant valves 14 disposed within the device which might be employed in forward and reverse configurations to form the device of FIGS. 3-4. The temperature actuated valve 14 may be composed of various metals, plastics, or other materials that expand or change shape in response to heat. Such memory materials include but are not limited to Nitenol which is an alloy composed of nickel and titanium which will change shape when heated and return to its original shape when cooled.

While all of the fundamental characteristics and features of the disclosed muffler device have been described herein, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention as defined herein.

What is claimed is:

1. A muffler for engagement to an exhaust gas conduit exiting an internal combustion engine, comprising:

a housing, said housing having a housing wall surrounding an interior cavity;

an inlet conduit communicating with said interior cavity, said inlet adapted for sealed engagement to an exhaust pipe communicating with said engine;

an exhaust conduit communicating with said interior cavity, said exhaust conduit providing a exit for exhaust gasses communicated through said interior cavity from said inlet conduit;

a first pathway defined by a first conduit communicating between said inlet aperture and said exhaust conduit, said first pathway defining a first means for sound suppression for said exhaust gasses communicating therethrough;

said first conduit communicating through a temperature actuated first valve, said first valve having a cold position allowing a communication of said exhaust gasses to said exhaust conduit and having a heated position wherein it is closed and prevents said communication of said exhaust gasses to said exhaust conduit from said inlet conduit;

said first valve actuated from said cold position to said heated position by heat from said exhaust gasses;

a second pathway defined by a second conduit communicating between said inlet aperture and said exhaust conduit, said second pathway defining a second means for sound suppression;

said second conduit communicating through a second valve, said second valve formed by an interior passage of a first tube, said interior passage defined by a surrounding sidewall, said interior passage in a communication with said inlet conduit;

said first tube transtatably engaged for movement within a chamber wall surrounding said first tube between a cold position, and heated position;

said first tube having an aperture communicating through said sidewall with said interior passage;

a hole formed in said chamber wall, said hole aligning with said aperture, only when said first tube is located to said heated position;

said first tube actuated from said cold position to said heated position by heat from said exhaust gasses;

said first means for sound suppression having a higher said sound suppression capability than said second means for sound suppression;

a communication of said exhaust gasses occurring through said muffler along said first pathway when said first valve and said first tube are in respective said cold positions, and through said second pathway when said first valve and said first tube are heated by said exhaust gasses and move to said respective heated positions;

said communication of exhaust gasses along said first pathway providing a first level of noise suppression to said muffler when said engine is cold;

said communication of exhaust gasses along said second pathway providing a decrease in said noise suppression to said muffler from said first level of noise supression, upon a warming of said engine; and whereby, said muffler provides increased noise suppression to said internal combustion engine when said engine is cold and a reduced level of noise suppression is provided thereto once said engine warms.

2. The muffler of claim 1 additionally comprising:

said first tube actuated from said cold position to said heated position by a spring engaged with one end of said first tube; and said spring exerting a biasing force against said first tube in a direction toward said heated position, said biasing force increasing as said spring is heated by said exhaust gasses.

3. The muffler of claim 2 additionally comprising:

said first conduit terminating at a second end in an outlet chamber, said outlet chamber in a communication with said exhaust conduit;

said temperature actuated first valve being a plate in hinged engagement positioned to rotate and cover said second end of said first conduit when in said heated position; and heat activated biasing means to rotate said plate to cover said second end in a response to heat communicated thereto from said exhaust gasses.

4. The muffler of claim 1 additionally comprising:

said first conduit terminating at a second end in an outlet chamber, said outlet chamber in a communication with said exhaust conduit;

said temperature actuated first valve being a plate in hinged engagement positioned to rotate and cover said second end of said first conduit when in said heated position; and heat activated biasing means to rotate said plate to cover said second end in a response to heat communicated thereto from said exhaust gasses.

* * * * *